US005345900A

United States Patent [19]

Wisegerber

[11] Patent Number: 5,345,900

[45] Date of Patent: Sep. 13, 1994

[54] ENGINE STARTER

[76] Inventor: Lester R. Wisegerber, 38 Brown La., Dayton, Tex. 77535

[21] Appl. No.: 16,305

[22] Filed: Feb. 11, 1993

[51] Int. Cl.[5] ..... F02N 11/12

[52] U.S. Cl. ..... 123/179.24; 123/179.26; 29/888.011

[58] Field of Search ..... 123/179.26, 179.25, 123/185.12, 179.24; 74/7 C, 550; 192/42; 29/888.011

[56] References Cited

U.S. PATENT DOCUMENTS 1,199,612 9/1916 Rice ..... 123/185.12
1,547,921 7/1925 Hunt ..... 74/550
2,901,911 9/1959 Duncan ..... 123/179.26
3,596,647 8/1971 Heiser ..... 123/179.26
4,372,263 2/1983 Costa ..... 123/179.26
4,569,315 2/1986 Bodnar ..... 123/179.26

*Primary Examiner*—Andrew M. Dolinar
*Attorney, Agent, or Firm*—Donald H. Fidler

[57] ABSTRACT

A power starter for a rope started gasoline engine where an end of the crankshaft is modified to have an exterior with transverse pins or clutch surfaces which are engagable with a positive driver surfaces in a socket which is attachable to a power drill. The power drill is an alternative starting mechanism to a rope starter or vice-versa.

4 Claims, 2 Drawing Sheets

ENGINE STARTER

FIELD OF THE INVENTION

This invention relates to rope started gasoline engines and more particularly, to a system for modifying and constructing such engines for starting with a power drill in preference to a rope pulling mechanism.

BACKGROUND OF THE INVENTION

Rope started gasoline engines commonly come in two and four cycle models and are widely applied to lawnmowers, edgers, outboard motors, tiller motors, air compressors, and so forth. Anyone who has had the opportunity to utilize one of these devices knows first hand that frustration often accompanies the starting or non-starting function and that often times considerable strength and endurance is required to crank a balky engine into operation.

To my knowledge, the only attempt to relieve this particular problem is a rubber conically shaped attachment for a power drill which is used to engage a conically shaped recess located on the terminal end of a crankshaft. This system has a number of significant drawbacks which include non-reliability of the frictional gripping engagement; great force is required on the drill to maintain engagement; a bulky redesign of the crankshaft end is required and the system lacks a positive drive.

In rope started engines, the rope is about three feet in length and is wrapped around a spring based spool mounted on a crankshaft. The spool carries a spring member which is tensioned as the rope on the spool is pulled and which rewinds the rope on the spool when the pull on the rope is released. The spool is keyed by a one-way clutch to the crankshaft so that a pull on the rope engages the clutch and rotates the crankshaft for self ignition of the engine. When the engine fires up, the crankshaft rotates free of the spool by virtue of the free wheeling clutch.

The problem is that rope started engines are sometimes difficult to start and often time require strenuous efforts and exertion.

SUMMARY OF THE PRESENT INVENTION

The present invention can be applied to retrofit existing engines and to newly manufactured engines. Rope started engines typically have a crankshaft with a projecting end portion which receives a free wheeling clutch and a rope starter spool. The rope starter spool is enclosed within a cover so that a rope handle can be located on the exterior of the cover.

In the present invention, the clutch and rope spool are removed so that the end of the crankshaft can be drilled and tapped using guides for a precision fit to receive an extension member. The extension member is provided with wrench flats for attachment purposes and with diametrically arranged driving pins which extend radially outward for the extension member. A socket member is utilized as a driver and has diametrically arranged clutch slots in its side wall with a stop shoulder in each slot to engage positively with the driving pins and an inclined ramp in each slot. The socket member is adapted to be received in a power driver which is used to rotate the crankshaft until the engine starts and at that time the inclined ramps permit the free-wheeling disengagement of the power driver from the crankshaft. The cover is provided with an opening so that the cranking can be done exterior to the engine. The power driver is an alternate starting mechanism to the rope pulley or vice-versa.

In another form of the invention, an attachment nut in a clutch mechanism is removed and replaced with an extension member which has a threaded nut at its lower end and has the driving pins at an upper end.

DESCRIPTION OF THE INVENTION

Figure 1:
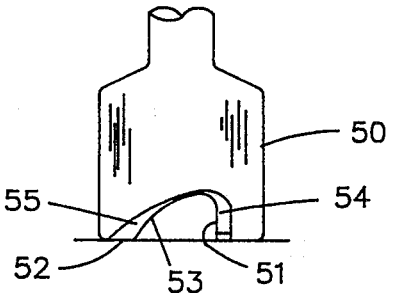
FIG. 1 is a side view of a conventional lawnmower.
Figure 1:
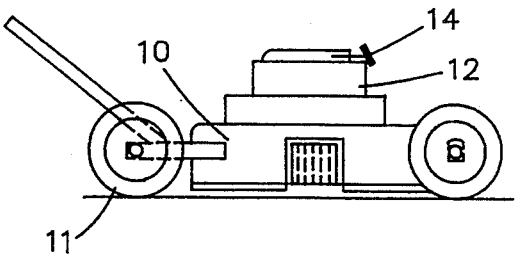

Referring now to FIG. 1, a typical lawnmower is illustrated where a blade housing 10 is mounted on wheels 11 and a two cycle gasoline engine 12 has a crank shaft (not shown) connected to a lawnmower blade (not shown). A rope pull 14 requires a pull to start the engine.

Figure 2:
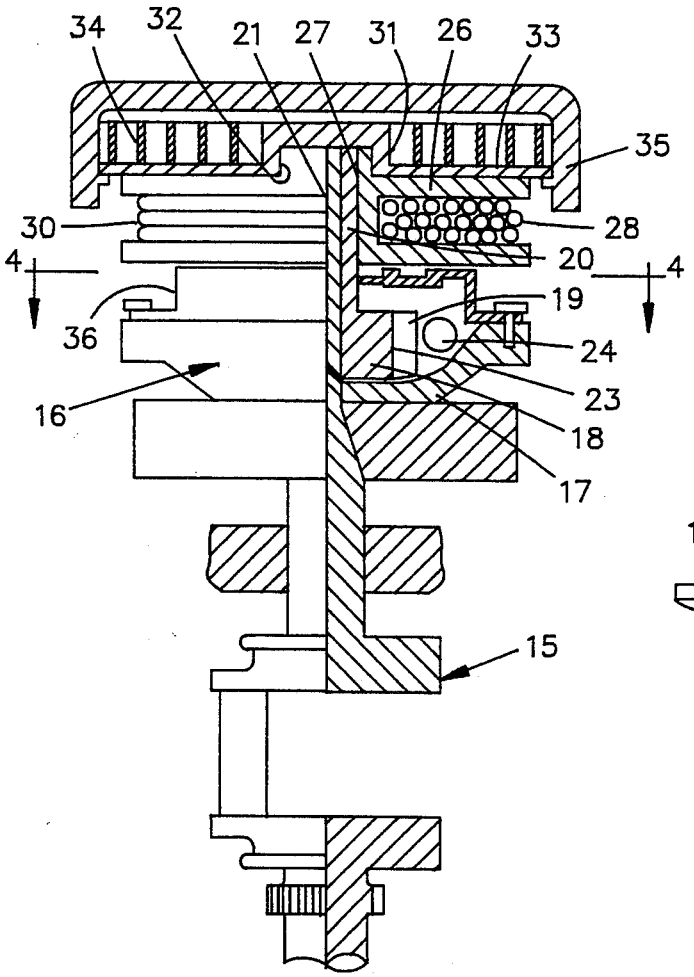
FIG. 2 PRIOR ART
FIG. 2 is a view in longitudinal cross-section through a crankshaft clutch, rope pulley and cover for a typical lawnmower.

Referring now to FIG. 2, typically a crankshaft 15 and upper assembly for a lawnmower is illustrated. It will be readily appreciated that engines such as used on a lawnmower are widely utilized in other types of applications. At the upper end of the crankshaft is a one way ball bearing clutch 16. The clutch 16 has a clutch housing 17 which is threadedly attached to the crankshaft 15 and rotates together with the shaft 15. A clutch driver member 18 has a lower clutch pawl 19 located in the clutch housing 17 and an upwardly extended, square shaped, driving shaft 20. The clutch driver member 18 also has a central bore 21 which is slidably and rotatably received on the upper cylindrical end 28 of the crankshaft 15. The clutch pawl 19 has lugs 23 which, upon rotation in one direction, cause ball members 24 in the clutch housing 17 to engage pawl recesses in the clutch housing 17 so that the housing 17 and the crankshaft 15 can be rotated in one direction. When the engine fires up, the crankshaft 15 then rotates at a higher speed in the same direction and the clutch housing 17 is released from engagement of the clutch pawl 19.

To rotate the crankshaft 15 and fire up the engine, a rope pulley 26 is provided. The pulley 26 has a square socket 27 which is slidably but non-rotatively received on the driving shaft 20 of the driver member 18. The rope 30 on the pulley 26 is pulled to unwind from the pulley 26 and to rotate the crankshaft 15. At the upper end of the pulley 26 is a non-circular drive portion 31 which is received in a non-circular bore 32 in a spring plate 33. On the upper side of the spring plate 33 is a spirally wound coil spring 34 which has one end attached to a hub on the spring plate and its other end attached to a housing 35 for the pulley. When the rope 30 is unwound from the pulley 26, the spring 34 is wound up so that when the pulling force is released from the rope, the spring force on the pulley rewinds the rope. The spring plate 33 is rotatably mounted in a pulley cover 35 which is usually attached by screws to the housing for the lawnmower.

Figure 4:
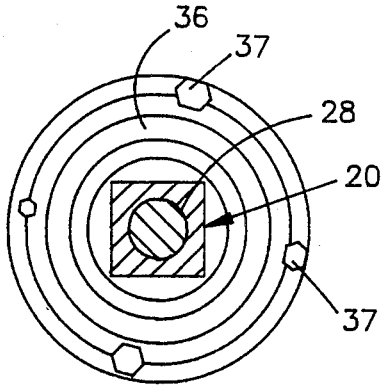
FIG. 4 is a view taken along line 4—4 of FIG. 2.
Figure 3:
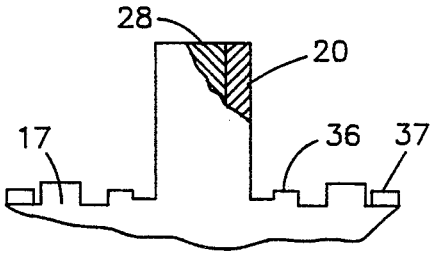
FIG. 3 is a view of a clutch element with the rope spool removed.

As shown in FIG. 3 and 4, in this type of mower, the clutch pawl 19 is located under a pawl cover 36 which is attached to the clutch housing 17 by a number of machine screws 37.

In the present invention, the pulley cover 35 and attached spring 34 are first removed by unfastening and removing the pulley cover 35. Next, the pulley 26 is removed by sliding it off of the pawl shaft 20 which leaves the pawl driving shaft 20 and the pawl cover 36 as shown in FIGS. 3 and 4. Next, the pawl cover 36 is removed by unscrewing the screws 37 and the pawl cover 36 and the pawl member 18 are removed leaving the cylindrical end 28 of the crankshaft 15 exposed.

Figure 5:
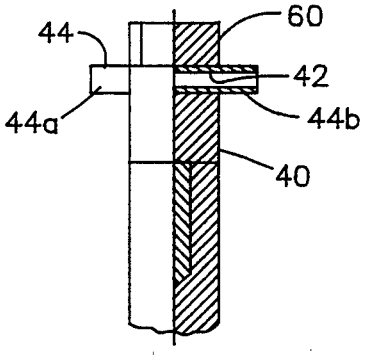
FIG. 5 illustrates a socket driven member and an aligned extension member.

The end 28 of the crankshaft is then drilled and tapped to receive a threaded extension member. To drill the hole, a hardened precision tabular guide is fitted over the end of the crankshaft and provides a guide opening for drill. Another hardened precision tubular guide is fitted over the drilled end of the crankshaft and provides a guide opening aligned with the drilled opening for a tapping member. A cylindrical extension member 40 (see FIG. 5) with the same diameter as the end 28 of the crankshaft is threadedly attached to the end of the crankshaft by a threaded pin end. The extension member 40 has a transverse bore 42 which receives a hardened pin member 44 which can be a "c" hardened steel pin. The extension member 40 is also preferably made from hardened material for strength and impact resistance. The pin member 44 is located so that there are pin elements **44*a*, 44*b* diametrically arranged and projecting outwardly from the outer surface extension member 40**.

After the end of the crankshaft has been modified, the pawl member 18, the pawl cover 36 and pulley 33 are reassembled. An opening is cut into the pulley cover 35 to attach the extension member 40 to the end of the crankshaft.

A driving socket member 50 has a bore 5 1 to be slidably received over the end of the extension member 40. In the transverse end surface 52 of the socket member are diametrically arranged clutch recesses 53. Each clutch recess 53 has a forward stop surface 54 and an inclined ramp surface 55 arranged so that when the recesses 53 receive the pin elements **44*a*, 44*b*, the stop surfaces 54, upon rotation of the socket member 50, will positively drive the crankshaft and, upon firing of the engine, the inclined surfaces 55 will release or disconnect the pin elements 44*a*, 44*b* from the stop surfaces 54**.

Figure 6:
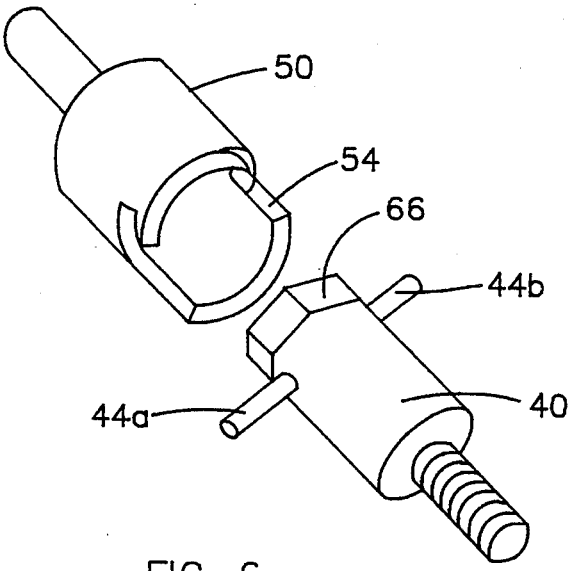
FIG. 6 is similar to FIG. 5 but showing the elements in perspective.

As shown more clearly in FIG. 6, the upper end of the extension member 40 wrench flat surfaces 66 for attachment of the extension to the end of the crankshaft.

With the foregoing system, a crankshaft can be modified or manufactured new to provide an extension member with transverse pin elements which can be driven by a power drill. Thus, cranking of the crankshaft by a pulley is not necessary and the pulley can be used as a backup starting device. Alternatively, if starting is usually with a pulley, a power drill and the extension member can be used as a backup starting device.

Figure 9:
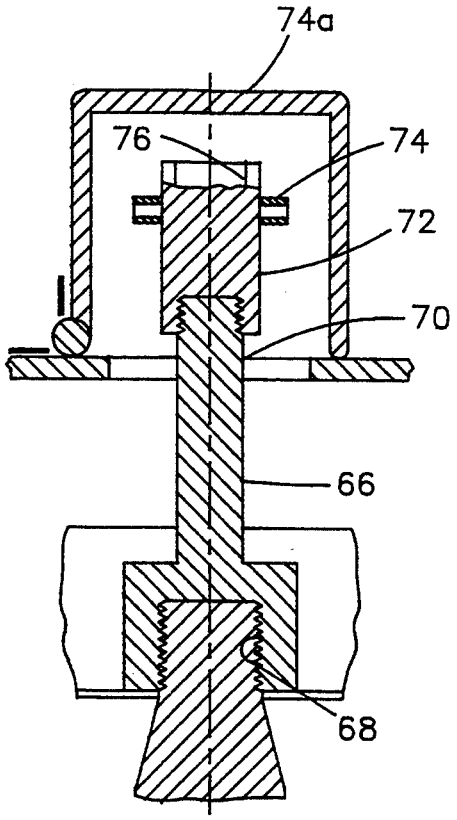
FIG. 9 is a view of the modification of the clutch device in accordance with the present invention.
Figure 7:
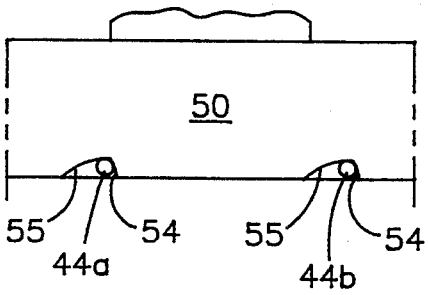
FIG. 7 is a plan layout for 360° of the socket member for illustrating slot arrangement.
Figure 8:
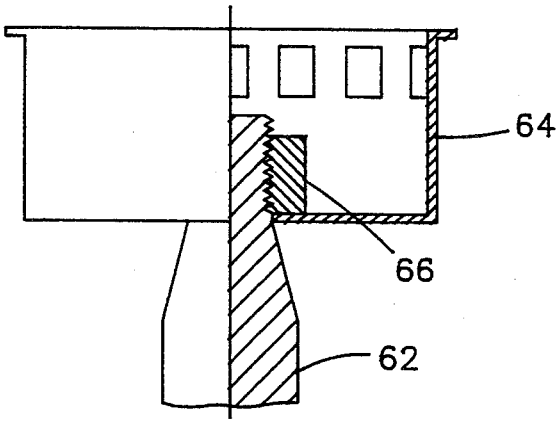
FIG. 8 is a partial cross-sectional view through a different type of clutch device which is commonly used.

Referring now to FIGS. 8 and 9, the partial upper end of a crankshaft 62 and a different form of typical clutch housing 64 are illustrated. With this type of clutch unit, a nut 66 is used to threadedly attach the end of the crankshaft 62 to the clutch housing 64. To modify this system to the present invention, an extension member 66 with a threaded bore 68 is substituted and the upper end 70 of the extension is modified to threadedly receive an extension driver member 72 with pin elements 74. In this arrangement, the end of the extension is provided with a hex socket 76 for use in attachment.

On the pulley cover, a spring biased cup cover **74*a* is provided to enclose the end of the extension member for safety purposes. It also will be apparent that a hole could be provided in the cup cover 74*a*** for access while enclosing the extension.

Figure 10:
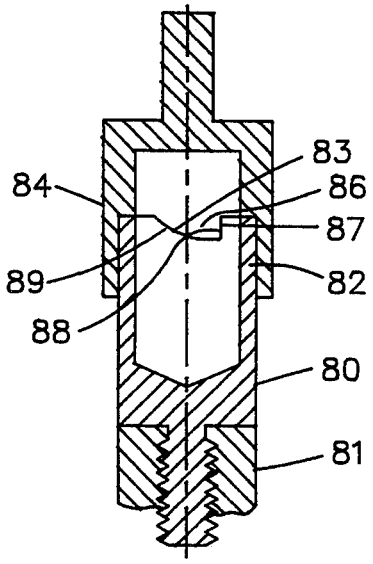
FIG. 10 is a view of another form of the invention.

Referring now to FIG. 10, a modification is illustrated where a cylindrical extension member 80 is threadedly attachable to a drilled and tapped end 81 of a crankshaft. The extension member 80 has a tubular end 82 which has diametrically opposed clutch recesses 83 (only one shown). A driving socket 84 has a tubular end which slidably fits over the end 82 of the extension member 80. In the interior of the driving socket 84 is a recessed counterbore 85 and diametrically opposed driving teeth 86 (only one shown). A driving tooth 86 has a vertical driving surface 87 which engages a vertical driven surface 88 in a clutch recess 83. Upon rotation of the driving socket 84 by a power drill, the engaged surfaces 87, 88 positively drive the crankshaft and, upon firing of the engine, clutch surfaces 89 on the driving teeth 86 release the crankshaft from a positive driving connection with the driving socket. It will be appreciated that various types of interengaging clutch surfaces could be employed, if desired. Wrench flat surfaces are located on the outer surfaces of the extension member 80 for attachment purposes.

It will be apparent to those skilled in the art that various changes may be made in the invention without departing from the spirit and scope thereof and therefore the invention is not limited by that which is disclosed in the drawings and specifications but only as indicated in the appended claims.

I claim:

1. In a manual pull starting engine having a crankshaft coupled to a pull starting mechanism which has a clutch release upon starting of said engine, an improvement comprising:

a cylindrically shaped extension member on the end of said crankshaft, said extension member extending outwardly of a pulley on said crankshaft, said extension member having projecting transverse pins located diametrically from one another, said extension member being a separate element which is threadedly coupled to said crankshaft at one end and has wrench flats at its other end; and a socket member having one end sized for sliding reception on said extension member and having diametrically located clutch recesses with shoulders for engaging said pins for rotation of the crankshaft to start said engine and having inclined surfaces for release from said pins upon starting of said engine, said socket member having a shank at its other end for reception in a drill means.

2. In a manual pull starting engine having a crankshaft coupled to a pull starting mechanism which has a clutch release upon starting of said engine, an improvement comprising:

a cylindrically shaped extension member on the end of said crankshaft, said extension member extending outwardly of a pulley on said crankshaft, said extension member having a tubular end with drive element comprised of recesses located about a longitudinal axis, of said recesses having a driven vertical surface and an inclined release surface, a socket member having one end sized for sliding reception on said extension member and having drive shoulder surfaces located about a longitudinal axis of the socket member for engaging said drive elements for rotation of the crankshaft to start said engine, said socket member further having inclined surfaces which are complimentary to the inclined surfaces in the socket member for release of said socket member from the drive elements on the extension member upon starting of said engine, said socket member having a shank at its other end for reception in a power driver means; and said drive shoulder surfaces and said inclined surfaces in said socket member being located in a counterbore in said socket member.

3. A method for modifying a manual pull starting engine having a crankshaft coupled to a pull starting mechanism having a clutch release upon starting of said engine, comprising the steps of:

disassembling the protective cover over said pull starting mechanism and removing the mechanism to expose a terminal end of the crankshaft;

drilling and tapping said end of the crankshaft to provide a threaded opening along the center line of said shaft;

providing an opening in the cover over said starting mechanism;

attaching a driving element to said end by a threaded portion where said driving element has diametrically located transverse pins which cooperate with a driving socket for rotatively driving said driving element and attached crankshaft.

4. The method as set forth in claim 3 wherein said drilling is performed using a precision guide member with a drilling center opening and said tapping is performed with a precision guide member having a tapping center opening aligned with said drilling center opening.

* * * * *